United States Patent [19]

Ciaramitaro et al.

[11] 4,435,232

[45] Mar. 6, 1984

[54] EXPLOSIVE COMPOSITION

[75] Inventors: David A. Ciaramitaro; Jack M. Moore, both of Benson, Ariz.

[73] Assignee: Apache Powder Company, Benson, Ariz.

[21] Appl. No.: 448,874

[22] Filed: Dec. 10, 1982

[51] Int. Cl.[3] ..... C06B 45/00

[52] U.S. Cl. ..... 149/2; 149/21; 149/52; 149/66; 149/94; 149/95

[58] Field of Search ..... 149/2, 21, 52, 66, 94, 149/95

[56] References Cited

U.S. PATENT DOCUMENTS

| | | | |
|---|---|---|---|
| 423,230 | 3/1890 | Emmens | 149/12 |
| 1,444,594 | 2/1923 | Dehn . | |
| 1,880,116 | 9/1932 | Stratton . | |
| 2,211,737 | 8/1940 | Berkley et al. | 52/11 |
| 2,314,806 | 3/1943 | Winning | 52/11 |
| 2,314,832 | 3/1943 | Kirst et al. | 52/11 |
| 2,358,384 | 9/1944 | Davis | 52/11 |
| 2,365,170 | 12/1944 | Bitting et al. | 52/13 |
| 3,728,174 | 4/1973 | Reinhart | 149/21 |
| 3,881,970 | 5/1975 | Falconer et al. | 149/47 |
| 4,142,927 | 3/1979 | Walker et al. | 149/105 |
| 4,196,026 | 4/1980 | Walker et al. | 149/105 |
| 4,233,095 | 11/1980 | Ghosh et al. | 149/95 |
| 4,304,614 | 12/1981 | Walker et al. | 149/105 |
| 4,317,691 | 3/1982 | Katsuta et al. | 149/89 |
| 4,336,085 | 6/1982 | Walker et al. | 149/89 |

*Primary Examiner*—Stephen J. Lechert, Jr.
*Attorney, Agent, or Firm*—Townsend & Townsend

[57] ABSTRACT

An improved explosive composition comprises a carbonaceous absorbent formed from processed cellulose, a liquid explosive and an oxygen-supplying salt. By adding varying amounts of nitrocellulose, the composition may form a gelatin or semigelatin dynamite.

9 Claims, No Drawings

EXPLOSIVE COMPOSITION

BACKGROUND OF THE INVENTION

1. Field of the Invention

The present invention relates generally to explosive compositions of the type comprising a liquid explosive, an oxygen-supplying salt, and a carbonaceous absorbent, and more particularly to an explosive composition having an improved carbonaceous absorbent.

2. Description of the Prior Art

Dynamite is a blasting explosive that is made from a liquid explosive, typically nitroglycerin or ethylene glycol dinitrate (EGDN), absorbed in a porous material together with an oxygen-supplying salt. By adding a small amount of a nitrate ester of cellulose, gelatin dynamite or gelignite is formed. Such gelatin dynamites form a plasticized mass which is water resistant and capable of being formed into a desired shape. Semigelatin dynamites incorporate about one-half the nitrocellulose and less nitroglycerin than gelatin dynamites and have physical properties between dynamites and gelatin dynamites. Both dynamites and semigelatin dynamites may include a major portion of ammonium nitrate as a substitute explosive for the nitroglycerin.

The absorbent material in such formulations is typically a ground carbonaceous material of vegetable origin such as ground plant stalk, wood flour, sawdust, bagasse, and the like. Usually, such low-density absorbents are combined with less absorbent, but higher density, materials such as ivory nut and meal, apricot pit meal, and the like. The relative amounts of low-density and high-density carbonaceous materials may be balanced to provide an explosive having a desired density and explosive strength.

Formulations of the type just described are well-known in the art and suffer from certain common drawbacks. The amount of highly-absorbent low-density carbonaceous material that can be added is limited by the need to provide complete combustion of the carbonaceous material. Incomplete combustion leads to the formation of carbon monoxide which can be toxic when the explosive is used in an enclosed space, such as an underground mine. The limited amount of absorbent material leads to a less stable explosive which can exude the liquid explosive at high temperatures and/or after prolonged storage.

A second problem relates to gelatin dynamites, which are commonly used in seismographic oil exploration, which requires that they may be submerged in water at high pressure. The formulations must resist the incursion of water for periods extending up to ten or more days without desensitization to detonation by the blasting cap. The desensitization results from both the compression of microscopic air bubbles in the gelatin by the high hydrostatic pressure and the incursion of water into the explosive which dissolves the oxidizing salts reducing the loading density. Thus, while gelatin dynamite is typically considered waterproof, the cell cavities of the ground plant tissues which form the absorbent are vulnerable to penetration by water at high pressure. The result is the penetration of the cell cavities by water. The result is that the explosive becomes discontinuous with small accumulations of water held in individual cell cavities. Such a structure adversely affects the detonation-propagation characteristics of the explosive leading to a reduction of the detonation velocity and finally, incomplete or low-order detonation.

Thus, it would be desirable to provide an explosive composition which is stable and resists loss of the liquid explosive even at high temperatures, as well as being water-resistant even when held under high pressure for a number of days.

The use of various ground cellulose materials as an absorbent or fuel in an explosive composition is revealed in a number of prior patents. For example, U.S. Pat. No. 1,444,594 discloses the use of sawdust, ground bark and ground nut shells, each of which is primarily cellulose. Other patents reveal the use of ground plant stalks, moss and wood flour (U.S. Pat. No. 2,211,737); ground barley flour (U.S. Pat. No. 2,314,806); ground ivory nut meal, rice meal and linseed meal (U.S. Pat. No. 2,314,832); rye flour and flaked vegetable grains (U.S. Pat. No. 2,358,384); almond hull pulp (U.S. Pat. No. 1,880,116); bagasse, ground walnut hulls and apricot pits (U.S. Pat. No. 3,728,174); wheat flour (U.S. Pat. No. 3,881,970); and tamarind seed flour and guar (U.S. Pat. No. 4,233,095). Heretofore, the use of processed cellulose material in which the lignin has been removed and the cell wall broken has not been known in the prior art.

U.S. Pat. No. 3,728,174 also discloses the addition of hollow, resinous plastic spheres to a gelatin dynamite to provide extra air bubbles which are resistant to collapse at high pressure. Such "microballoons" do not prevent water incursion, however.

SUMMARY OF THE INVENTION

The present invention is an improved explosive composition of the types generally known as dynamite, gelatin dynamite and semigelatin dynamite. The improvement results from the use of processed cellulose, typically either raw paper pulp or ground paper, as the carbonaceous absorbent. Such compositions provide a highly absorbent explosive which resists the loss of liquid explosive even at high temperatures. Moreover, when formed with nitrocellulose as a gelatin or semigelatin, the explosive composition is highly water-resistant even over extended periods at high pressure.

DESCRIPTION OF THE PREFERRED EMBODIMENT

The present invention is an improved explosive composition of the type comprising a liquid explosive, an oxygen-supplying salt, and a carbonaceous absorbent. Depending on the characteristics desired, the composition may also include ammonium nitrate and nitrocellulose, as described in detail hereinafter. The invention is characterized by the use of a comminuted, processed cellulose as at least a portion of the carbonaceous absorbent. The remaining carbonaceous absorbent will typically comprise carbonaceous material having a higher density than the processed cellulose.

The use of processed cellulose as the carbonaceous absorbent is beneficial in that the material is more highly absorbent than the carbonaceous absorbents of the prior art. By carefully controlling the ratio of liquid explosive to that of the processed cellulose, the explosive forms a continuous mass with few interstitial spaces to allow the incursion of water. Moreover, the processed cellulose fibers form a matrix which provides a continuity to the explosive mass not attainable by unprocessed particles. Such a mass provides a desirable detonation-propagation characteristic with the detonation wave being transmitted efficiently through the explosive. Additionally, the explosives are more resistant to exuding the liquid explosive on storage at high temperatures, providing a stable and long lasting explosive package.

The term "processed cellulose" is defined to include all vegetable matter which has been treated to remove the lignin fraction leaving hollow fibers consisting primarily of cellulose. Common vegetable sources of cellulose include cotton, ramie, flax, linen, hemp, sisal, jute, straw, and the woody trunks and branches of trees and shrubs.

Removal of the lignin fraction of the cell wall may be accomplished in a variety of ways well known in the prior art. For example, various paper pulping processes consist primarily of removing some or all of the lignin from the vegetable material to permit fiber separation. Most commonly, the pulping is achieved chemically using reagents such as calcium bisulfite in the presence of excess sulfur dioxide (the sulfite process); or without excess sulfur dioxide (the bisulfite process); a mixture of sodium sulfide and sodium hydroxide (the kraft process); or a solution of sodium sulfite buffered with sodium carbonate or bicarbonate (the neutral sulfite semichemical process). Various mechanical processes, (such as the groundwood process) are also suitable so long as a substantial portion of the lignin is removed from the vegetable material.

The processed cellulose must be dried prior to use in the explosive composition of the present invention. It is preferred that the individual fibers be dried to form a matrix having dimensional stability. Such dimensional stability allows the processed cellulose absorbent to act as a binder and forming the explosive composition. The dimensions of the matrix are not critical, although the aggregates formed should be small enough to allow efficient absorption of the liquid and other materials in the explosive composition.

While raw paper pulp will serve as an excellent source of processed cellulose, it is usually uneconomic to divert such pulp from paper production. Moreover, the use of ground paper, such as newspaper, computer paper, cardboard and the like, has been found to be a suitable source of ground cellulose. Suitable ground paper may be produced by a high-speed hammer mill with $\frac{1}{8}$ inch screen openings, but this dimension is not critical.

The term "liquid explosive" embraces various nitrate esters, such as nitroglycerine, ethylene glycol dinitrate, lower nitrate esters of glycerol and ethylene glycol, dinitro chlorohydrin, tetranitro diglycerine, and acetyl and formyldinitroglycerines, as well as nitroalkanes, such as nitromethane and its homologs, alkyl nitrates, such as methyl nitrate and its homologs and low-melting aromatic nitro compounds. Such liquid explosives are well known.

The oxygen-supplying salt is typically a nitrate such as sodium nitrate or ammonium nitrate. The ammonium nitrate is also an explosive which may replace the liquid explosive in part, as described hereinafter. Other oxidizing salts include chlorates and perchlorates. The identity of the oxygen-supplying salt is not critical and many such salts are well-known in the art.

In addition to the processed cellulose, liquid explosive, and oxygen-supplying salt, the explosive composition in the present invention may include other components. Most commonly, ammonium nitrate can be substituted for a portion of the liquid explosive. The addition of ammonium nitrate to dynamite and semigelatin dynamite is well-known and need not be described further.

Usually, a high-density absorbent, such as apricot pit meal or ivory nut meal, will be added to adjust the density of the explosive composition. The substitution of the high-density absorbent allows a more dense composition while still providing the necessary amount of carbon to allow complete combustion when necessary.

The preferred compositional ranges for the components of the explosive composition of the present invention are set forth in the following table.

| | Preferred Composition (weight percent) | |
|---|---|---|
| | Broad | Narrow |
| Liquid Explosive | 5.0–93.0 | 15.0–50.0 |
| Processed Cellulose | 1.0–30.0 | 4.0–10.0 |
| High-Density Absorbent | 0.0–10.0 | 1.0–5.0 |
| Oxygen-Supplying Salt | 5.0–50.0 | 5.0–35.0 |
| Ammonium Nitrate | 0.0–85.0 | 2.0–80.0 |
| Gelling Agent | 0.0–5.0 | 0.0–3.0 |
| Chalk | 0.0–2.0 | 0.5–1.5 |

The relative amounts of each of the components will depend on a number of factors. The amount of liquid explosive will depend primarily on the desired strength of the explosive composition. More powerful explosives will contain a greater amount of liquid explosive. Under some circumstances, it will be possible to substitute ammonium nitrate for a portion of the liquid explosive. This is desirable in that ammonium nitrate is more economical, but provides less energy and a less powerful explosive. The processed cellulose is added to absorb the liquid explosive to provide a stable explosive composition and facilitate packaging of that composition. The amount of processed cellulose, which is a low-density material, may be balanced against the amount of high-density absorbent to obtain an explosive composition having the desired overall density. Oxygen-supplying salt is added in an amount necessary to provide substantially complete combustion of the carbon and nitrogen present in the composition. This will, of course, depend on the amount of the liquid explosive, processed cellulose, and high-density absorbent, each of which includes combustible carbon and hydrogen. The gelling agent is supplied if it is desired to form a gelatin or semigelatin explosive composition, as described hereinafter. Explosives of this type, employing carbonaceous absorbents other than processed cellulose, are well known in the art and need not be described further. The substitution of processed cellulose for such other carbonaceous absorbents will affect primarily the amount of oxygen-supplying salt necessary to provide substantially complete combustion. Also, it will usually be desirable to balance the amount of high-density absorbent to achieve the desired overall density.

The explosive composition of the present invention may be in the form of a dynamite, a gelatin or a semigelatin. The dynamite composition will include little or no nitrocellulose and forms a relatively non-plastic material. The dynamite may include up to 85 weight percent ammonium nitrate. The following formulations are representative of dynamite formulations which would employ the processed cellulose absorbent of the present invention. The first formulation is a medium-strength explosive employing only nitroglycerin. The second formulation is a medium-strength explosive where the major portion of the nitroglycerin has been replaced by ammonium nitrate. The final composition is a low-strength explosive formulation without ammonium nitrate.

| TYPICAL DYNAMITE FORMULATION (weight percent) | |
|---|---|
| Nitroglycerin | 40% |
| $NaNO_3$ | 46% |
| Comminuted Newsprint | 9% |
| Apricot Pit Meal | 4% |
| Chalk | 1% |
| **DYNAMITE WITH AMMONIUM NITRATE (weight percent)** | |
| Nitroglycerin | 15% |
| Ammonium Nitrate | 37% |
| $NaNO_3$ | 30% |
| Comminuted Newsprint | 7% |
| Apricot Pit Meal | 3% |
| Chalk | 1% |
| **LOW NITROGLYCERIN FORMULATION (weight percent)** | |
| Nitroglycerin | 15% |
| $NaNO_3$ | 69% |
| Comminuted Newsprint | 12% |
| Apricot Pit Meal | 3% |
| Chalk | 1% |

Any of the above formulations may be gelatinized by the addition of nitrocellulose in the manner well-known in the prior art. Usually, the nitrocellulose will be first partially added to the nitroglycerin to begin gel formation. The processed cellulose absorbent and any high-density absorbent are then added to the partially-gelled material and allowed to be fully absorbed. The remainder of the nitrocellulose is added to the mixture to complete the gel formation. The resulting gelatin or semi-gelatin is a plastic mass with few unoccupied cavities to allow the intrusion of water. The ends of the processed cellulose fibers tend to form a matrix, giving a continuity to the explosive mass which is not found in compositions which employ the carbonaceous absorbent of the prior art.

The following are offered by way of example and not by way of limitation.

EXPERIMENTAL

1. Absorbency Determination

Table 1 sets forth the densities and nitroglycerin (NG) absorbencies of a number of vegetable materials. The nitroglycerin absorbencies were determined by the centrifuged Gooch crucible method. Snelling and Storm, "The Analysis of Black Powder and Dynamite", Bulletin 51, Bureau of Mines (1913) pp. 7–8. Excess of nitroglycerin is added to a weighed sample of absorbent, stirred in and allowed to sit for four hours. The wet material is placed into a Gooch crucible and centrifuged at 600 rpm for five minutes. The weight of absorbent with the nitroglycerin remaining after centrifugation is compared with the dry weight of absorbent to determine the percent of absorption. All vegetable materials were ground to a mesh of between about 10 and 325.

TABLE 1

| Vegetable Material | Density (gm/cc) | NG Absorbency (%) |
|---|---|---|
| Ground Newsprint | 0.19 | 76.3 |

TABLE 1-continued

| Vegetable Material | Density (gm/cc) | NG Absorbency (%) |
|---|---|---|
| Bleached Hardwood Pulp | | 65.8 |
| Unbleached Softwood Pulp | | 62.3 |
| Oat Hulls | 0.24 | 40.7 |
| Ground Corn Cobs | 0.12–0.29 | 22.2–55.5 |
| Apricot Pit Meal | 0.75–0.79 | 37.0–47.0 |
| Bagasse | 0.15 | 60.8 |
| Wood Flour | 0.25 | 59.4 |

As can be seen from Table 1, the density of ground newsprint compares favorably with other low-density absorbents, while the nitroglycerin absorbency exceeds that of the best prior art material (bagasse) by more than 25%. The other processed cellulose material, bleached hardwood pulp and unbleached softwood pulp, also display higher absorbencies than the prior art material.

2. Resistance to Exudation

Comparable dynamite formulations, one employing the processed cellulose absorbent of the present invention and the other employing the prior art absorbent material, were tested for both high temperature exudation and for explosive velocity. The explosives were packaged in 1¼ inch by 8-inch dynamite cartridges and placed in an oven held at 40° C. for eleven days. After that time, the bagasse/wood flour composition had exuded nitroglycerin to within 2½ inches of the outside of the waxed paper wrapping, while the newsprint formulation showed only a few spots of nitroglycerin on the portion of the paper directly in contact with the powder. The explosive velocities were then measured in air using a Hewlett-Packard Model 5245L Counter-Chronograph. The formulations and measured explosive velocities are set forth in Table 2.

TABLE 2

| Component | Formulation A | Formulation B |
|---|---|---|
| Nitroglycerin | 50 | 50 |
| Ground Newsprint | 8 | — |
| Wood Flour | — | 7 |
| Bagasse | — | 7 |
| Sodium Nitrate | 41 | 35 |
| Chalk | 1 | 1 |
| Velocity (ft/sec) | 16,626 | 12,136 |

As observed, the explosive velocity of the newsprint formulation compares favorably with that of the bagasse/wood flour formulation.

3. Water-Pressure Resistance Test

Velocity tests were performed on a variety of formulations as set forth in Table 3. The explosive cartridges were primed and enclosed in a water-filled steel pipe pressurized by compressed air to 150 pounds. Detonating cords of equal length were embedded into the explosive at the end opposite the cap in a position three inches ahead of the other cord. The start and stop circuits were wired to the ends of the detonating cords, and the circuits of the Counter were activated by the disintegration of the wire by the detonation of the cord. The Chronograph was checked between shots with 3-foot lengths of detonating cord of known velocity. The explosive cartridges were immersed in water at 150 psi for a number of days, after which time the explosive velocities were determined as described hereinbefore. The results are set forth in Table 4.

TABLE 3

| MATERIAL (Weight %) | FORMULATION NO. 1 | 2 | 3 | 4 | 5 | 6 | 7 |
|---|---|---|---|---|---|---|---|
| Nitroglycerin | 51.5 | 49.6 | 49.5 | 49.3 | 49.4 | 49.6 | 49.6 |
| Nitrocotton | 1.7 | 1.7 | 0.6 | 0.9 | 2.2 | 1.4 | 1.4 |
| Sodium Nitrate | 30.8 | 31.3 | 40.5 | 31.2 | 39.2 | 39.5 | 39.5 |
| Ammonium Nitrate | — | 2.6 | — | — | — | — | — |
| Chalk | 1.7 | 1.4 | 0.9 | 0.5 | 1.3 | 1.0 | 1.0 |
| Processed Cellulose | — | — | — | — | — | 5.0 | 3.5 |
| Apricot Pit Meal | 2.0 | — | — | — | 1.8 | 2.0 | — |
| Bagasse | 3.6 | — | 2.0 | — | 2.3 | — | 3.5 |
| Wood Flour | 7.7 | 7.3 | 4.2 | 9.4 | 2.5 | — | — |
| Microballoons | 0.7 | 0.5 | 0.8 | 0.6 | 0.7 | 1.5 | 1.5 |
| Coal | — | 1.0 | — | — | — | — | — |
| Sawdust | — | 4.4 | — | — | — | — | — |
| Starch | — | — | 1.2 | 6.9 | — | — | — |
| Water | 0.3 | 0.2 | 0.3 | 1.2 | 0.6 | — | — |

The results clearly indicate that the formulations which include the ground newsprint (Nos. 6 and 7) display a better resistance to water incursion. In particular, Formula 7, which includes 5% processed cellulose displayed substantially complete water resistance for a period of five days and leveled off at a loss of explosive velocity of only about 50%.

4. Water Resistance of Semigelatin

The addition of ground paper to a semigelatin formula improves the water resistance markedly, bringing it more into the class of gelatins. The following formula comparison illustrates this:

TABLE 5

| Ingredient | Percentage I | II |
|---|---|---|
| Nitroglycerin | 23.0 | 23.0 |
| Nitrocellulose | 0.3 | 0.3 |
| Ammonium Nitrate | 60.7 | 60.7 |
| Sodium Nitrate | 8.4 | 8.4 |
| Oathulls | 2.6 | — |
| Newsprint | — | 2.6 |
| Starch | 4.7 | 4.7 |
| Chalk | 0.3 | 0.3 |
| Velocity, Unconfined (ft/sec) | 8803 | 10593 |

TABLE 4

| Formulation No. | | Detonation Velocity (ft./sec.) 1 | 2 | 3 | 4 | 5 | 6 | 7 |
|---|---|---|---|---|---|---|---|---|
| Days | 0 | 18,382 | 18,727 | 18,727 | 8,425 | 18,997 | 19,014 | 18,327 |
| Immersed | 2 | 7,692 | 5,494 | 7,788 | 7,042[b] | 8,207 | 22,060 | 10,040 |
| | 5 | —[a] | — | — | — | — | 15,432 | 7,396 |
| | 7 | — | — | — | — | — | 18,285 | — |
| | 9 | — | — | — | — | — | 20,893 | — |
| | 16 | — | — | — | — | — | 9,948 | — |

[a]indicates incomplete or low-order detonation
[b]velocity taken at 75 psi because of low unconfined velocity Slit Cartridge Test:

48 hr. partial detonation complete detonation 72 hr. partial detonation complete detonation The slit cartridge test involves slitting the sides of a $1\frac{1}{4}$ inch by 8-inch waxed paper-wrapped cartridge of the explosive to be tested and putting it underwater at ambient temperature and pressure for the time desired. In the cases above, both the cartridges incorporating oathulls in the formula failed to detonate fully after 48 hours immersion. Fragments of undetonated explosive were recovered from the testing area. The formula with the ground paper detonated completely after 72 hours immersion. Considering that 70% of these formulations are extremely water-soluble nitrate salts, the ability of ground paper to resist the incursion of water is quite impressive.

Although the present invention has been described in some detail by way of illustration and example for purposes of clarity of understanding, it will be obvious that certain changes and modifications may be practiced within the scope of the appended claims.

We claim:

1. An explosive composition comprising:

a low density carbonaceous absorbent formed at least in part from comminuted, processed cellulose;

a liquid explosive absorbed onto the low-density, carbonaceous absorbent, said carbonaceous absorbent remaining substantially chemically unchanged after absorption of the liquid explosive; and an oxygen-supplying salt.

2. An explosive composition as in claim 1, wherein the comminuted, processed cellulose is ground paper.

3. An explosive composition as in claim 1, wherein the comminuted, processed cellulose is ground newsprint.

4. An explosive composition as in claim 1, wherein the comminuted, processed cellulose is present at from about 1 to 30 weight percent of the composition.

5. An explosive composition as in claim 1, wherein the comminuted, processed cellulose is present at from about 4 to 10 weight percent.

6. An improved explosive composition of the type including a liquid explosive at from 5 to 93 weight percent, a carbonaceous absorbent at from 1 to 30 weight percent, and an oxygen-supplying salt at from 5 to 50 weight percent, wherein said liquid explosive is absorbed by said carbonaceous absorbent without substantial chemical modification of said absorbent, and, wherein said improvement is forming at least a portion of the carbonaceous absorbent from comminuted, processed cellulose.

7. An improved explosive as in claim 6, wherein the processed cellulose is paper ground in a high speed hammer mill with $\frac{1}{8}$ inch screen openings.

8. An improved explosive composition as in claim 6, wherein the processed cellulose is present at from 4 to 10 weight percent.

9. An improved explosive composition as in claim 6, further including nitrocellulose at up to about 5 weight percent.

* * * * *